United States Patent [19]

Chapa

[11] Patent Number: 4,684,288

[45] Date of Patent: Aug. 4, 1987

[54] ASPHALTIC PAVEMENT TILES

[76] Inventor: Xavier Chapa, 45 S. Ridge, Canyon, Tex. 79015

[21] Appl. No.: 821,496

[22] Filed: Jan. 22, 1986

[51] Int. Cl.[4] ..... E01C 5/12

[52] U.S. Cl. ..... 404/35; 404/44; 404/45; 404/73; 404/82; 428/40; 428/489

[58] Field of Search ..... 404/18, 28, 29, 31, 404/32, 34, 35, 44, 45, 73, 82; 428/40, 489; 52/388, 390, 612

[56] References Cited

U.S. PATENT DOCUMENTS

| | | | |
|---|---|---|---|
| 3,568,579 | 3/1971 | Hoad | 404/35 |
| 3,853,682 | 12/1974 | Hurst | 428/40 |
| 4,074,948 | 2/1978 | Heater, Jr. | 404/35 X |
| 4,151,025 | 4/1979 | Jacobs | 404/31 X |
| 4,478,912 | 10/1984 | Uffner et al. | 428/40 X |

FOREIGN PATENT DOCUMENTS

| | | | |
|---|---|---|---|
| 757778 | 4/1971 | Belgium | 428/489 |

*Primary Examiner*—Stephen J. Novosad
*Assistant Examiner*—John F. Letchford
*Attorney, Agent, or Firm*—Wendell Coffee; Montgomery W. Smith

[57] ABSTRACT

A pavement tile includes a section of reinforcing geotextile fabric coated on a top side with asphalt adhesive and a layer of asphalt aggregate mix or "hot mix" over the adhesive. The asphalt aggregate mix is compacted to a desired thickness and degree of compaction. Asphalt is applied over a bottom side of the fabric, and a peelable backing applied over the asphalt. For repair of deteriorated pavement, the protective backing is simply peeled off, and the pavement tile applied over the deteriorated spot of wear course. New paved surface or large repairs can be made by simply adjoining tiles. The tiles are preferably made in batches. A large sheet is spread with the layers of asphalt adhesive and asphalt aggregate mix, and compacted. The large sheet is cut into tiles, and the asphalt and backing applied to individual tiles. The tiles are stacked in batches of six on a convenient crate with handles. In addition to repair of asphalt aggregate paved wear courses, the tiles can also be used to repair concrete wear courses with the appropriate substitution of adhesive, and if desired, reinforcing fabric.

9 Claims, 9 Drawing Figures

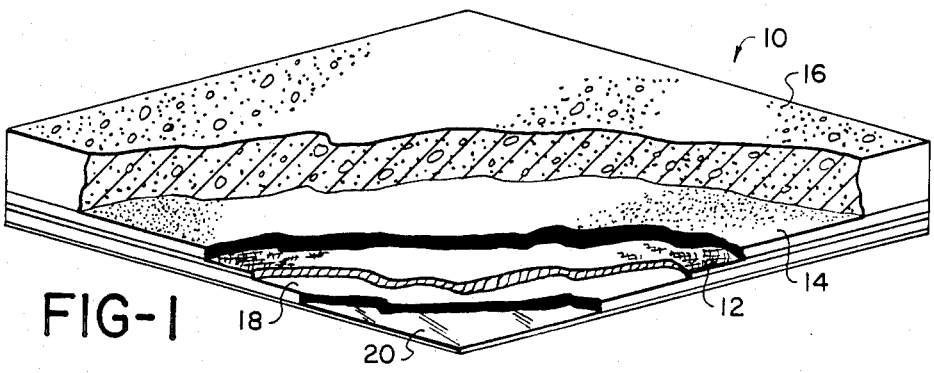
FIG-1
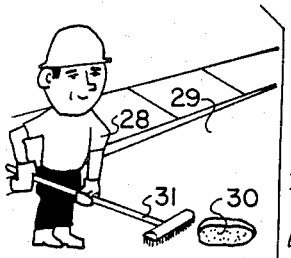
FIG-2
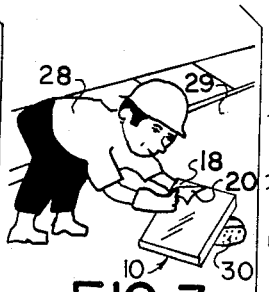
FIG-3
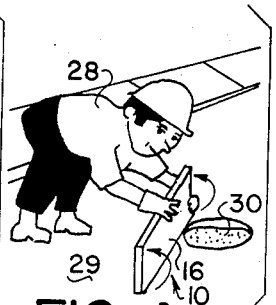
FIG-4
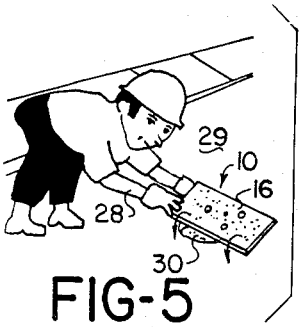
FIG-5
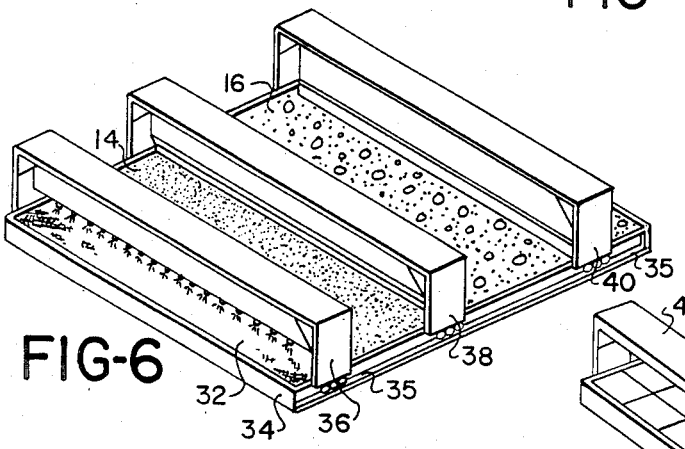
FIG-6
FIG-7
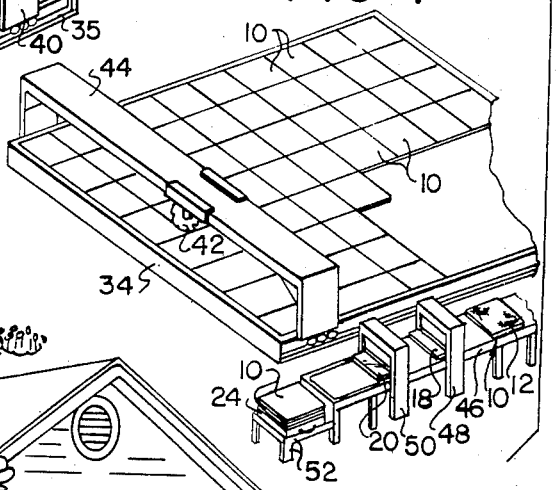
FIG-9
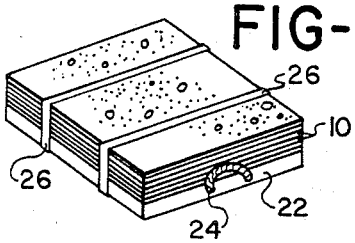
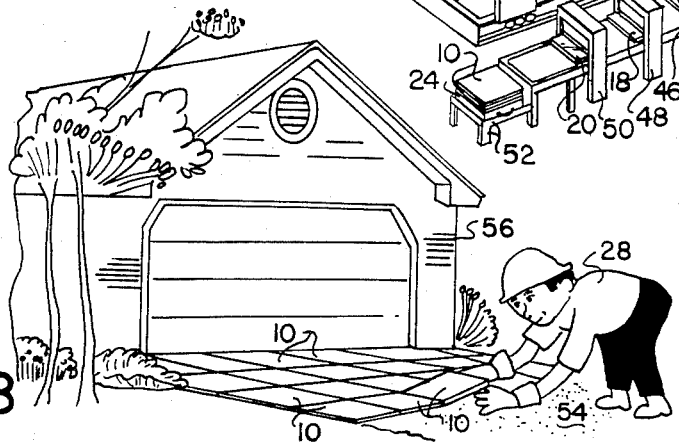
FIG-8

ASPHALTIC PAVEMENT TILES

STATEMENT AS TO RIGHTS TO INVENTIONS MADE UNDER FEDERALLY-SPONSORED RESEARCH AND DEVELOPMENT

There was no Federally-sponsored research and development concerning this invention.

BACKGROUND OF THE INVENTION

1. Field of the Invention

This invention relates to repairing of deteriorated pavement and other road courses. Applicant designates one with ordinary skill in the art to be a civil or highway engineer.

2. Description of Related Art

The wear course of road surfaces deteriorates from exposure to traffic and weather, necessitating repairs of cracks or holes. Such problems are preferably addressed in the early stages of deterioration.

Before my invention, it was customary to send out crews of men that would fill in holes or cracks with an asphalt aggregate mix, also known in the art as "hot mix," and then compact the hot mix. This required considerable equipment to maintain the hot mix in a desired condition, and to compact the patch, as well as shovels, spreaders, and other tools. Such repairs also took considerable time. The quality of the repair varied widely according to differences in workers, climate, and times of day.

Before this application was filed, a search was made in the United States Patent and Trademark Office. That search developed the following patents:

| | |
|---|---|
| NAGEL | 292,037 |
| WALKER | 794,206 |
| CASLER | 1,187,259 |
| ABERNATHY | 2,413,901 |
| FAIR | 2,701,219 |
| ALPS | 2,880,116 |
| VASILOFF | 3,557,671 |
| LEVY | 3,608,444 |
| HURST | 3,741,856 |
| HURST | 3,900,102 |
| CORRIGAN | 4,080,228 |
| MARZUCCHI | 4,175,978 |
| UFFNER | 4,362,586 |
| UFFNER | 4,451,171 |
| UFFNER | 4,545,699 |

Geotextile fabrics, such as polypropylene, are well known in the highway engineering art as a useful reinforcing base for asphalt aggregate mix or hot mix used to repair deteriorated road surfaces. The fabric helps to prevent reflective cracking, or transmission of cracks in the underlying pavement to the fresh layer of asphalt aggregate mix. Geotextile fabric also permits the use of thinner layers of asphalt aggregate mix. Such fabric is used with the standard repair method described above by placing the fabric over the deteriorated portion of wear course, and the asphalt aggregate is compacted onto the fabric at the site.

SUMMARY OF THE INVENTION

1. New Function and Surprising Results

I have invented a quick and simple structure and method for repairing deteriorated spots in roadway that does not involve the preparation, mixing, and compacting on site previously required.

According to my invention, personnel making roadway repairs simply locate a deteriorated spot in the roadway, and sweep or brush the area clean of dirt and loose particles to expose the pavement about the deteriorated spot. An asphalt pavement tile is placed upside down, and a flexible backing is peeled from a wear course adhesive coated bottom of the tile. The tile is then inverted with the top, asphalt aggregate mix layer upward, and positioned or aligned above the deteriorated portion of the wear course. The worker then places the wear course adhesive directly against the deteriorated wear course. When repairing asphalt pavement, asphalt is preferably used as the wear course adhesive.

It is unnecessary to heat the asphalt coating on the bottom side of the tile, unless the tile is used for making repairs under extremely cold conditions. In that case, it may be desirable to heat the asphalt slightly, only to insure that the tile is adhered sufficiently to the pavement as vehicles roll over it.

The preferred form of the asphaltic tile is a $2' \times 2'$ or $3' \times 3'$ square. A top side of geotextile fabric is preferably coated with an asphalt adhesive and then spread with a layer of fine grade asphalt aggregate mix, compacted as desired. A bottom side of the fabric is coated with asphalt and covered with a flexible peelable protective backing. Because the backing is also preferably nonadhesive to the asphalt aggregate mix, the tiles may be stacked in groups of six on an appropriate crate, with rope or string carrying handles for convenience.

Although the tiles described above used asphalt as a wear course adhesive for adhering the tile to pavement, it is also within the scope of the invention to utilize similar tiles based on epoxies and concrete compatible materials to repair deteriorated concrete roadways.

The tiles are preferably made in batches by spreading the hot mix over asphalt adhesive on a large sheet of the fabric supported by a planar base. The large sheet is then cut into smaller, standard square tile sections, and the asphalt and backing applied to individual tiles. Because the formation of the tiles can be controlled more carefully, under optimum conditions, at a single location convenient to the hot mix, fabric, asphalt, adhesive and other base materials, and equipment for their application, the tiles will be of more uniform compaction, thickness, and of higher quality than is possible for individual, onsite repairs patches.

The tiles can also be used to construct new pavement for small projects such as a homeowner making a paved driveway. In such cases, the asphalt aggregate mix layer will be substantially thicker than for the pavement repair tiles.

Therefore, my invention produces the unexpected result of eliminating many of the steps previously required for on site repair of deteriorated pavement or other wear course, with a higher quality more durable patch.

Thus, it may be seen that the total function of my invention far exceeds the sum of the functions of the individual parts such as asphalt, aggregate, fabric, adhesive etc.

2. Objects of this Invention

An object of this invention is to repair deteriorated wear course of existing road surfaces.

Another object of this invention is the construction of new road surfaces.

Further objects are to achieve the above with a device that is durable, simple, safe, efficient, versatile, ecologically compatible, energy conserving, and reliable, yet inexpensive and easy to manufacture, install, arrange, and maintain.

Other objects are to achieve the above with a process that is versatile, ecologically compatible, energy conserving, rapid, efficient, and inexpensive, and does not require skilled people to install, arrange, and maintain.

The specific nature of the invention, as well as other objects, uses, and advantages thereof, will clearly appear from the following description and from the accompanying drawing, the different view of which are not scale drawings.

BRIEF DESCRIPTION OF THE DRAWING

FIG. 1 is a perspective view of an asphaltic pavement tile made according to this invention.

FIGS. 2 through 5 show a process of repairing asphalt pavement with the tile shown in FIG. 1.

FIGS. 6 and 7 show a process for making the asphaltic pavement tiles according to my invention.

FIG. 8 is a perspective view of an exemplary driveway of asphaltic tiles.

FIG. 9 is a perspective view of asphaltic tiles packaged in a crate of six.

As an aid to correlating the terms describing this invention to the exemplary drawing the following catalog of elements is provided:

Catalog of Elements

10 pavement tiles
12 reinforcing fabric
14 asphalt adhesive
16 asphalt aggregate mix
18 wear course adhesive
20 peelable backing
22 crate
24 handles
26 bands
28 worker
29 roadway
30 deteriorated spot
31 broom
32 sheet of fabric
34 deck
35 tracks
36 adhesive sprayer unit
38 asphalt aggregate mix spreader unit
40 compacting unit
42 saw
44 cutting unit
46 conveyor
48 coating unit
50 backing unit
52 crate stand
54 base
56 house

DESCRIPTION OF THE PREFERRED EMBODIMENTS

Referring to FIG. 1, preferred asphaltic pavement tile 10, for use on asphalt aggregate mix wear course of paved road surfaces, includes geotextile fabric square 12, a thin layer of asphalt adhesive 14 applied over a top or top side of the fabric square, and a layer of compacted asphalt aggregate mix 16 applied over the asphalt adhesive 14 and fabric 12.

The asphalt aggregate mix 16 preferred includes fine pavement grade aggregate mix and about six percent (6%) asphalt by weight. Those with ordinary skill in the paving and highway construction art will recognize this as finish grade asphalt aggregate mix, also known as "hot mix". Other hot mix or wear course could also be used as the mix 16 if desired. Pavement grade asphalt adhesive, from AC 5 to AC 10, is preferably used as the adhesive 14.

Wear course adhesive in the form of asphalt 18 coats, or is applied over, a bottom or bottom side of the fabric 12 and is covered by a peelable flexible protective backing 20.

For repairing road surfaces where the wear couse is asphalt aggregate mix, the preferred fabric square 12 is a geotextile fabric, preferably polypropylene. Those in the highway engineering art are familiar with many different geotextile fabrics, meshes and the like that are available as reinforcing substructure for paved surfaces.

For concrete wear courses, it is anticipated that steel or wire meshes, or geotextile fabrics used in concrete roadway construction, would be substituted as reinforcing fabric for the exemplary polypropylene fabric described above.

Those involved in the highway construction art anticipate that reinforcing fabrics of increasing strengths will be developed in the foreseeable future. The scope of my invention would encompass these insofar as such fabrics could be advantageously used as reinforcing fabric.

I prefer to use asphalt as the wear course adhesive 18 for repairing deteriorated pavement wear course, because it is readily available, relatively inexpensive, and satisfactorily adheres the tile to the wear course. However, if desired, other asphalt adhereing compounds could be employed. If another wear course adhesive is used in place of the asphalt it may be necessary to use a peelable backing other than the silicone or wax paper preferred for the backing 20. Such backing must be peelable from the wear course adhesive and is preferably substantially nonadhesive to the asphalt aggregate mix 16.

For the repair of deteriorated portions of concrete wear course, some form of epoxy adhesive would preferably be used in place of asphalt as wear course adhesive 18. Those with ordinary skill in the highway engineering art, and especially in connection with repairs of concrete wear course will be able to specify the desired adhesive and reinforcing fabric 12 for use on concrete wear courses.

As shown in FIG. 9, the pavement tiles 10 may be conveniently stacked in groups of 6 or less on an appropriate crate 22 having rope and handles 24 to facilitate carrying the tiles. It is estimated that a 2×2 tile with a quarter inch thick layer of asphalt aggregate mix will weigh about 19 pounds. Thus, a stack of six tiles is about all that a worker can be expected to carry by himself. Bands 26 are preferably fastened around the crate or pallet 22 and tile 10. The bands 26 are cut when a crate of tiles is to be used. Of course, wire or other fastener could be employed in place of the bands 26.

FIGS. 2 through 5 show the method for applying the tiles to the deteriorated wear course. First, in FIG. 2, the paved roadway is swept free of loose dirt and particles, rocks, twigs, leaves, etc., at the deteriorated spot 30 of the wear course with broom 31 by worker 28. No other preparation of the wear course to be repaired is required.

As seen in FIG. 3, the worker 28 peels the backing 20 from the tile 10. The worker then inverts the tile 10 as shown in FIG. 4, and positions the tile 10 above the deteriorated spot 30 of the wear course. As seen in FIG. 5, the worker places the wear course adhesive 18, or asphalt, against the pavement, and presses the tile into place manually.

No preheating of the paved surface is required, and therefore, no unit for maintaining hot mix warm and loose is necessary. Further, because the asphalt aggregate mix 16 of the tile 10 is already compacted, no compaction unit is required at the repair site. Aside from the increased ease of repair and elimination of equipment for each repair crew, the time savings alone would be significant in using my invention over the prior art.

Although different sizes of tiles could be used for different sizes of wear course deteriorations, it is preferred that one uniform, relatively small, e.g. two feet square, square size be used, so that more than one tile may be used and adjoined in alignment to repair a crack or other pavement deterioration that is larger than the standard tile size. Because the tiles are preferably evenly cut with square edges, many tiles can be adjoined to cover a significant area, as desired.

Thus, the preferred method for preparing deteriorated wear course of road surfaces in this instance an asphalt aggregate paved wear course, preferably includes the following steps. First, the flexible backing is peeled from a bottom of a pavement tile 10, exposing a wear course adhesive coating over the bottom of the pavement tile 10. The pavement tile is inverted so that the asphalt aggregate mix layer on the tope of the pavement tile faces upward and the tile positioned above a deteriorated portion of the wear course of the road surface being repaired. The wear course adhesive or asphalt, is placed against the wear course of the roadway and pressed manually into place.

If the tile 10 is insufficient to cover the deteriorated portion of the wear course to be repaired, the first tile is aligned or positioned so that the outer edges or periphery of the tile are pressed against and cover the edge of the deteriorated spot of the wear-course. Then the procedure outlined above for individual tiles is repeated. On each repetition, the successive tiles is aligned so that the edges of the tile are aligned with, abutted against, and mated with the first tile, and any other tiles already placed on the pavement, so as to form a continuous wear course or road surface over the deteriorated spot, with the edges of the tiles being against or covering the entire periphery of the deteriorated spot on smooth undeteriorated road course.

FIG. 6 and 7 disclose an apparatus preferably used in efficiently making batches of the tiles 10. A large sheet 32 of geotextile fabric is preferably stretched across planar deck 34, and adjusted so that the tension within the sheet is substantially equal throughout. This insures a uniform tile, eliminates wrinkles in the fabric and assures that shifting in the fabric and dislocation or dislodging of the asphalt aggregaate mix therefrom does not occur. The fabric is not stretched significantly, but is merely pulled taut.

Once the sheet 32 is stretched across the deck 34, asphalt adhesive that will form the asphalt adhesive 14 of the tiles 10 is sprayed on or applied over the sheet 32 of fabric with sprayer unit 36 that rolls along tracks 35 at a periphery of the deck 34. Pavement grade asphalt adhesive, from AC 5 to AC 10, is preferably used.

After the asphalt adhesive is sprayed on the sheet 32 of fabric, fine asphalt aggregate mix that will form the asphalt aggregate mix 16 of the tiles 10 is applied to over the surface of the asphalt adhesive and sheet of fabric 32 with mix spreader unit 38 that also rolls along the tracks 35. The asphalt aggregate mix or hot mix is preferably a fine grade, typically using sand as the aggregate and having about 6 percent asphalt content by weight.

The layer of asphalt aggregate mix is then compacted to a desired extent to produce a uniform compaction and layer thickness with compacting unit 40 moved along the tracks 35. Although details of construction of the units 36, 38, and 40 are not disclosed, it is anticipated they will be similar to the pavement machinery commonly used in constructing roadways for spraying asphalt, spreading an even layer of hot mix, and compacting the hot mix.

It is anticipated that because the operations are performed at a single location, and performed repetitively, for many batches of tiles 10 with the flat subsurface of the deck 32, superior compaction and uniformity of the tiles 10 can be obtained.

After the compacted hot mix is allowed to cool and set, ordinarily about 30 minutes, it is then cut or sliced into square tiles 10, preferably 3'×3' or 2'×2', with saw 42, mounted on cutting unit 44. The cutting units rolls on the tracks 35, and saw 42 pivots and slides along the cutting unit 44, permitting right angle scuts to be made to form the square tiles 10. The heavy duty saw 42, is preferably a type that will produce smooth square edges of the tiles 10 to facilitate adjoining them to produce a continuous surface, as described above.

After the cutting step, the individual tiles 10 are preferably individually inverted and placed on conveyor 46. The conveyor 46 moves the tiles 10 through tile coating unit 48, where a layer of asphalt, as wear course adhesive 18, is applied to the bottom side of the fabric of each tile 10. It is anticipated that from about 0.05 or 0.10 gallons of asphalt would be required for the back of a 2'×2' square tile 10.

The conveyor 46 then transports the tiles 10 from the coating unit 48 to backing unit 50, where the backing 20 of each tile is then applied over the asphalt or wear course adhesive 18. The backing 20 protects the asphalt from contamination from foreign objects and allows stacking of the tiles. The paper is preferably silicon treated so that it will be retained on the bottom side of the tile 10 and fabric 12 but will be readily and easily peeled off of the tile to expose the asphalt 18 when desired. Of course, plastic films, wax paper, or other peelable flexible backings could be used instead of the preferred silicon treated paper.

As the tiles are rolled off of the end of the conveyor 36, the tiles are dropped onto one of the crates 22 resting on crate stand 52. After six tiles are deposited on the crate 22, the bands 26 are strapped around the crate 22 and the tiles 10, and a new crate 22 placed on the stand 52.

FIG. 8 shows the construction of a new paved surface, such as an exemplary driveway, using the tiles 10. Preferably level base 54 has been prepared. As with any road surface, the quality of the base 54 will to a large extent determine the durability of the resulting paved area. However, if desired the tiles 10 can be applied over almost any base, just as with hot mix paving techniques, where application of hot mix and compaction occur on site.

In constructing new pavement, the method of paving is substantially the same as that outlined above for repairing a large deterioration of the road surface that is larger than an individual tile 10, except that the area to be paved is selected and a base prepared over the area as desired.

The first pavement tile 10 is aligned with respect to the area to be paved. The first tile 10 is placed in the middle of the area to be paved and the steps for preparing each tile for placement on the base repeated. With each repetition, the successive pavement tile already placed on the base, thereby forming an increasingly enlarged square. The placement of the tiles in desirable alignment is continued until the entire area to be paved is covered with the new continuous pavement wear course.

The smooth straight edges of the tiles 10 permit their alignment and abutment adjoining each other to form a continuous paved surface. The seams will tend to disappear as the asphalt and aggregate at the edges of the pavement mesh together. Of course, the thickness of the layer 16 for use in constructing original paved surfaces would be thicker than the exemplary quarter inch thickness for repairing existing pavement, such as one-half inch (½") or one inch (1") thickness of the layer 16, or more if desired.

Because the tiles 10 are preferably made in batches, almost anylayer 16 thickness, tile size, tile shape, asphalt aggregate mix composition, and adhesive 18 can be supplied as desired and specified by the customer.

Thus, my invention provides for the satisfaction of almost any customer's desired specifications at a considerable cost savings over that required to transport special or unusual components or materials to the work site as required before my invention. With my invention, the required specifically prepared tiles can be made at the manufacturers site and easily transported to the customer's location as desired.

Because the tiles 10 are preferably made in batches, almost any layer 16 thickness, tile size, tile shape, asphalt aggregate mix composition, and adhesive 18 can be supplied as desired and specified by the customer.

Thus, my invention provides for the satisfaction of almost any customer's desired specifications at a considerable cost savings over that required to transport special or unusual components or materials to the work site as required before my invention. With my invention, the required specifically prepared tiles can be made at the manufacturers site and easily transported to the customer's location as desired.

The embodiment shown and described above is only exemplary. I do not claim to have invented all the parts, elements, or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

SUBJECT MATTER CLAIMED FOR PROTECTION

I claim as my invention:

1. A method of repairing deteriorated wear course of road surfaces, comprising the steps of:

a. peeling a flexible backing from a bottom of a pavement tile with the longest dimension not more than about 3 feet, b. exposing a wear course adhesive coating over the bottom of the pavement tile, c. inverting the pavement tile so that an asphalt aggregate mix layer over a top of the pavement tile faces upward, d. positioning the pavement tile above a deteriorated portion of wear course of a road surface, and e. placing the wear course adhesive coating of the pavement tile against the deteriorated wear course.

2. The invention as defined in claim 1 including all of the limitations a. through e. with the addition of the following limitations:

f. said pavement tile also including a section of reinforcing fabric between the asphalt aggregate mix and the wear course adhesive, g. said pavement tile further including asphalt adhesive betweent he fabric and the asphalt aggregate mix.

3. The invention as defined in claim 1 including all of the limitations a. through e. with the addition of the following limitations:

f. repeating the peeling step "a." through the placing step "e." above for each of a desired number of successive pavement tiles, and additionally with each repetition, g. aligning the successive pavement tile against another tile already placed on the deteriorated pavement to form a continuous road surface.

4. A method of paving, comprising the steps of:

a. selecting an area to be paved, b. preparing a base over the area as desired; then c. peeling a flexible backing from a bottom of a pavement tile with the longest dimension not more than about 3 feet, d. exposing a wear course adhesive coating over the bottom of the pavement tile, e. inverting the pavement tile so that an asphalt aggregate mix coating over a top of the pavement tile faces upward, f. alignming the pavement tile with respect to the area to be paved, g. placing the wear course adhesive coating of the pavement tile against the base;

h. repeating the peeling step "c." through the placing step "g." above for successive pavement tiles until the area to be paved has been covered, and additionally with each repetition, i. abutting the successive pavement tile against and mated with any adjacent pavement tile already placed on the base.

5. A tile for repairing deteriorated wear course of road surfaces, comprising:

a. a reinforcing geotextile fabric having a standard desired surface area and shape, b. asphalt adhesive applied over a top of the fabric, c. compacted asphalt aggregate mix applied to a thickness of about one fourth inch over the asphalt adhesive, d. wear course adhesive applied over a bottom of the fabric, dd. said tile not more than about 3' in its longest dimension, e. said wear course adhesive providing means for adhering the tile to a wear course being repaired, and f. a peelable backing applied over the wear course adhesive.

6. The invention as defined in claim 1 including all of the limitations a. through f. with the addition of the following limitation:

g. the asphalt aggregate mix including fine aggregate mix and about six percent asphalt by weight.

7. The invention as defined in claim 5 including all of the limitations a. through f. with the addition of the following limitations:

g. said wear course being pavement, h. said wear course adhesive being asphalt.

8. The invention as defined in claim 5 including all of the limitations a. through f. with the addition of the following limitation:

g. said wear course being concrete.

9. The invention as defined in claim 5 including all of the limitations a. through f. with the addition of the following limitation:

g. the backing being substantially nonadhesive to the asphalt aggregate mix.

* * * * *